US006684753B1

(12) United States Patent
Urrutia

(10) Patent No.: US 6,684,753 B1
(45) Date of Patent: Feb. 3, 2004

(54) RECIPROCATING DIFFERENTIAL HYDRAULIC MACHINE, ESPECIALLY A DIFFERENTIAL HYDRAULIC MACHINE

(75) Inventor: Stephane Urrutia, Baurech (FR)

(73) Assignee: Dosatron International, Tresses (FR)

( * ) Notice: Subject to any disclaimer, the term of this patent is extended or adjusted under 35 U.S.C. 154(b) by 0 days.

(21) Appl. No.: 09/913,065

(22) PCT Filed: Jan. 20, 2000

(86) PCT No.: PCT/FR00/00116

§ 371 (c)(1),
(2), (4) Date: Aug. 9, 2001

(87) PCT Pub. No.: WO00/47895

PCT Pub. Date: Aug. 17, 2000

(30) Foreign Application Priority Data

Feb. 9, 1999 (FR) ..... 99 01482

(51) Int. Cl.[7] ..... F01L 31/02
(52) U.S. Cl. ..... 91/344; 91/224
(58) Field of Search ..... 91/344, 235, 224

(56) References Cited

U.S. PATENT DOCUMENTS 4,558,715 A 12/1985 Walton et al. ..... 137/99
4,756,329 A 7/1988 Cloup ..... 137/99
5,137,435 A * 8/1992 Walton ..... 91/224
5,505,224 A 4/1996 Urrutia et al. ..... 137/99
5,513,963 A 5/1996 Walton ..... 417/403

FOREIGN PATENT DOCUMENTS

DE 197 28 179 A1 2/1998
EP 0 161 614 A2 11/1985
EP 0 255 791 B1 12/1989
EP 0 507 071 A1 10/1992

* cited by examiner

*Primary Examiner*—Edward K. Look
*Assistant Examiner*—Michael Leslie
(74) *Attorney, Agent, or Firm*—Connolly Bove Lodge & Hutz LLP

(57) ABSTRACT

A hydraulic machine comprising the following: an envelope (2); a differential piston (15) consisting of two parts **(15*a*, 15*b*) which have a different diameter and are able to move in two corresponding chambers (7,6); hydraulic switching means which are driven by the piston (15) and can take up two stable positions in relation to the piston; control means for a rapid change in the position of the switching means including elastic means (E); and releasing means that can release the energy accumulated by the elastic means at the end of the travel and result in an abrupt change in the position of the switching means. The switching means are supported by a side-walled (27) lantern ring (26) that is coaxial to the piston and is driven by the piston but which can take up two different stable positions in relation to the piston and elastic means (E) are disposed inside the lantern ring (26) and are internally guided by the side wall (27) of said lantern ring (26)**.

20 Claims, 8 Drawing Sheets

RECIPROCATING DIFFERENTIAL HYDRAULIC MACHINE, ESPECIALLY A DIFFERENTIAL HYDRAULIC MACHINE

The invention relates to a differential hydraulic machine, particularly a differential hydraulic motor, of the kind comprising:

an envelope;

a differential piston capable of sliding in a reciprocating movement in the envelope, the piston having two parts of different diameters capable of moving in two corresponding chambers of the envelope;

hydraulic switching means for supplying and evacuating the respective chambers, these switching means being driven by the piston and able to adopt two stable positions relative to the piston;

control means for an abrupt change in the position of the switching means relative to the piston, comprising elastic means capable of storing energy;

and triggering means capable, at the end of the stroke of the piston, of releasing the energy stored by the elastic means and of causing the abrupt change in position of the switching means, these triggering means comprising thrusting means which, at the end of the piston stroke, come to bear against stops which are fixed relative to the envelope.

A differential hydraulic motor of this type is known, for example, from EP-B-0255791 or from U.S. Pat. No. 5,505,224, and can be used as a device for injecting an additive into a main fluid. The elastic means consist of springs, the size of which is small by comparison with the components that make up the mechanism as a whole. These springs act transversely to the direction of travel of the piston and require transmission means of the connecting rod type, mounted so that they can rotate about axes of rotation which are generally orthogonal, or at least secant, to the lines of action of the forces developed by the springs.

FR-A-2619165 discloses a hydraulic motor which, according to the alternative form in FIG. 2, comprises elastic means exerting force along the geometric axis of movement of the piston. The spring is arranged around a rod inside a frame equipped, on its longitudinal sides, with sets of teeth collaborating with pinions controlling an eccentric and a connecting rod system. Arranging the spring along the axis of the piston allows simplification as regards the transmission of the forces exerted by this piston, but the spring remains small in size and the entire system is relatively complicated.

There is also disclosed, in DE-A-19728179, a hydraulic motor comprising a reciprocating differential piston which reverses automatically, particularly for a volumetric metering device. According to that document, the motor does not have controlled locking means, which means there is no sequential switching to guarantee repeatability and reliability. Locking is essentially hydraulic and switching is caused only by equilibria of pressure generated by direct action on sealing elements. The springs provided in that motor do not directly bring about the switching.

EP-A-0161614 discloses a differential hydraulic motor in which the triggering means comprise connecting rods subjected to the action of transversely arranged elastic means. The change in position of the valves and the reversal of the movement occur with impact of a spindle against some other component. These impacts are a source of noise and are detrimental to motor life.

U.S. Pat. No. 5,513,963 discloses a differential hydraulic motor in which the locking system is passive, that is to say not controlled. Switching is brought about only by direct action of the springs on the sealing elements which end up balancing the holding forces that result from the locking and from the hydraulic effects. Such a design does not make it possible to store up more energy than the energy capable of breaking the equilibrium.

The object of the invention is, above all, to provide a hydraulic machine, particularly a differential hydraulic motor, which is of simple construction while at the same time having elastic means exerting force along the geometric axis of movement of the piston and which makes it possible to reduce the friction caused by the spring load and the guiding surfaces. The invention also aims to extend the life of the devices by reducing component wear. The efficiency and speed of operation of the machine are also to be improved. The design of the machine has to allow sequential switching, which guarantees repeatability and reliability, and to allow more energy to be stored than is capable of breaking equilibrium, so as to have a high operating margin.

According to the invention, a reciprocating differential hydraulic machine, particularly a differential hydraulic motor, of the kind defined previously, comprises elastic means exerting force along the geometric axis of movement of the piston, and is characterized in that:

the switching means are carried by a lantern ring with a side wall coaxial with the piston, driven by this piston but capable of adopting two different stable positions relative to the piston, and the elastic means are arranged on the outside of the lantern ring and are guided internally by the side wall of this lantern ring.

Advantageously, the elastic means comprise a spring coaxial with the lantern ring and surrounding it. In particular, the spring is a helical compression spring.

This spring may thus have a large diameter and a large wire cross section, making it possible to obtain good operational flexibility. The large cross section of the wire of the spring gives it good resistance to corrosive wear.

As a preference, the lantern ring is guided in its lower part by a cylindrical region of the differential piston.

At least one push-rod is provided at each axial end of the lantern ring, the push-rod or push-rods of one end being independent of the push-rod or push-rods of the other end of the lantern ring, these push-rods bearing against the elastic means and being retained axially by stops provided on the lantern ring, which guides the push-rods in a translational movement.

The lower push-rod may have a diametral crossmember equipped with a rod coaxial with the piston, projecting on the opposite side to the elastic means. The rod passes in sealed fashion through a transverse wall of the piston and comes into abutment, at the bottom end of travel, against a transverse bar which bears against a part of the envelope. The bar may be mounted so that it can slide in a support connected to the piston.

The diametral crossmember may be secured to a ring bearing against the lower rim of the lantern ring, this ring surrounding the side wall of the lantern ring which has two longitudinal guide openings through which the crossmember passes.

Two diametrically opposed upper push-rods are provided and are guided by the lantern ring, particularly by longitudinal openings.

The lantern ring may comprise an upper plate equipped, on the inside, with two diametrically opposed cutouts in which the upper push-rods are engaged and slide. The upper plate may be assembled by clip-fastening.

The switching means advantageously comprise valves.

The assembly consisting of the lantern ring, of the elastic means and of the push-rods exhibits axial symmetry of construction guaranteeing that the various forces involved are in equilibrium, and making it possible to reduce risks of jamming.

The lantern ring is advantageously held stable in one of its two positions relative to the piston by a device of the toggle-joint type, with three axes, comprising a connecting rod and a trigger.

The connecting rod is articulated at one end to the upper plate of the lantern ring and at its other end to the trigger; the trigger is itself articulated to a component connected to the piston.

The trigger comprises two diametrically opposed extensions capable of coming into abutment against a stop connected to the piston, respectively above and below this stop following rotation through about 180°, each extension of the trigger being capable of collaborating with a projection provided respectively on an upper push-rod and on a lower push-rod so as to trip the trigger when the elastic means are under sufficient load.

Apart from the provisions explained hereinabove, the invention consists of a certain number of other provisions which will be dealt with more explicitly hereinbelow in a detailed description of some exemplary embodiments, with reference to the appended drawings, but which are not in any way limiting.

FIG. 1 of these drawings is a vertical axial section through a differential hydraulic motor according to the invention.

Figure 4:
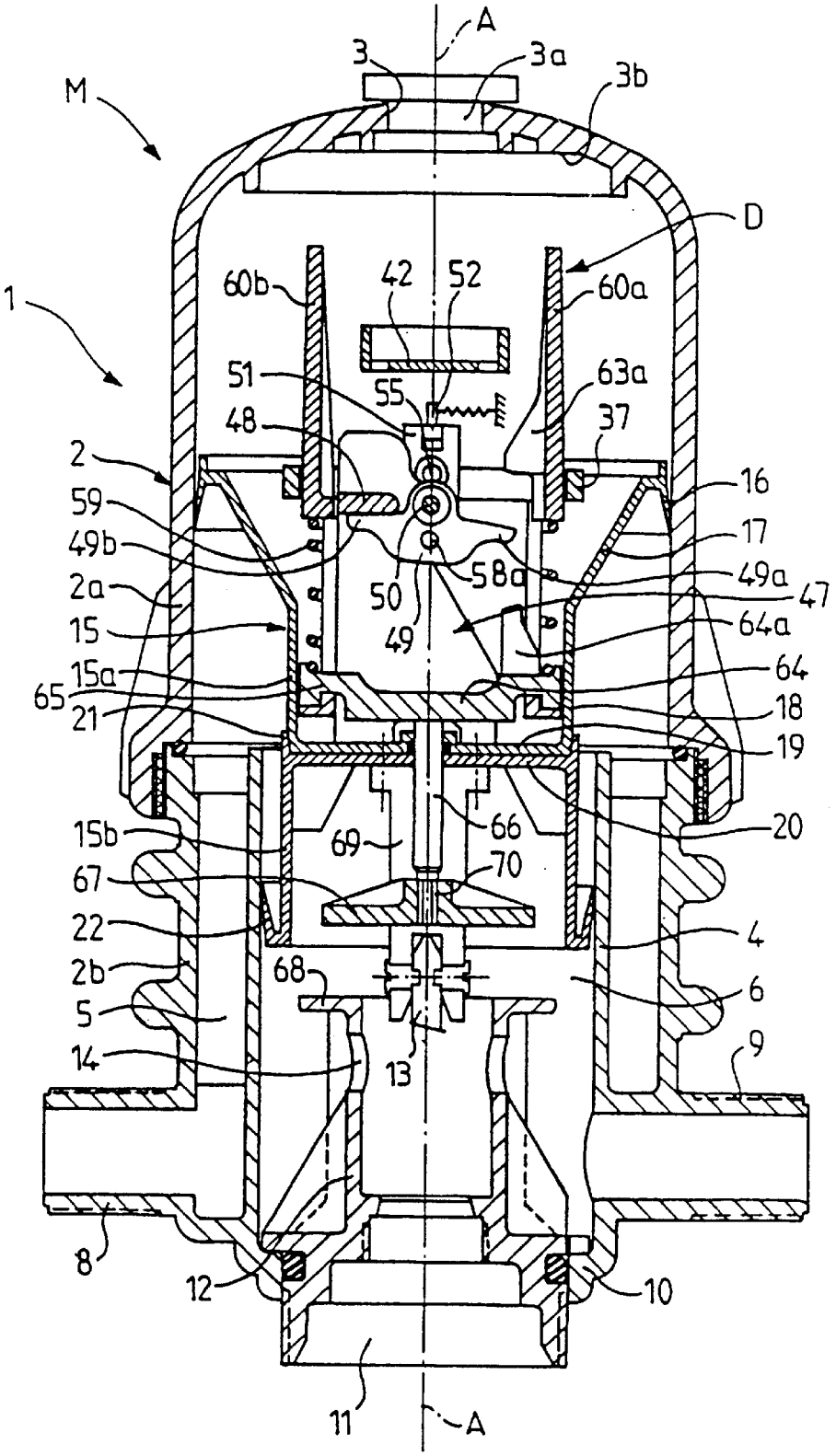
FIG. 4 is a partial axial section similar to FIG. 1 showing the hydraulic motor in another configuration.
Figure 11:
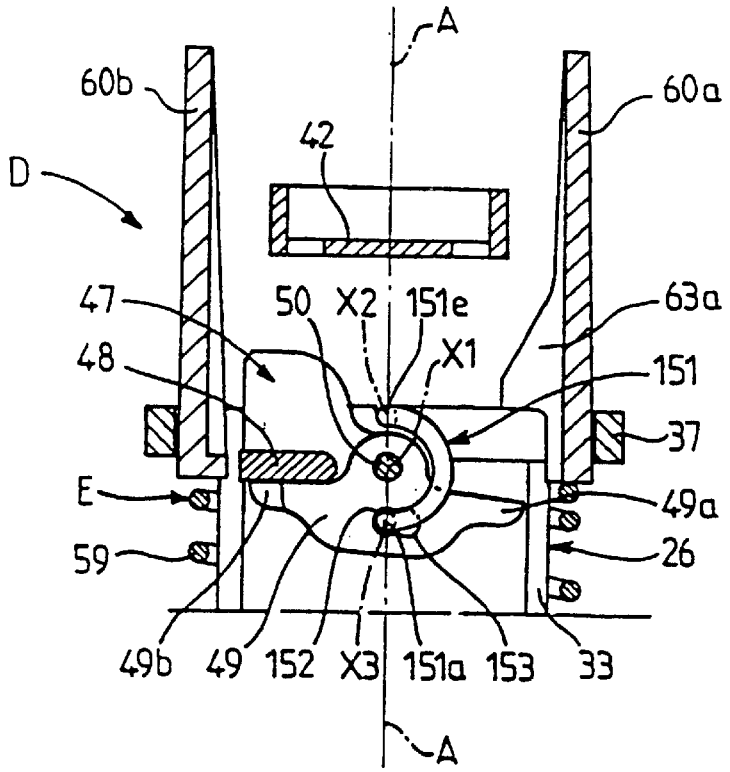
Figure 10:
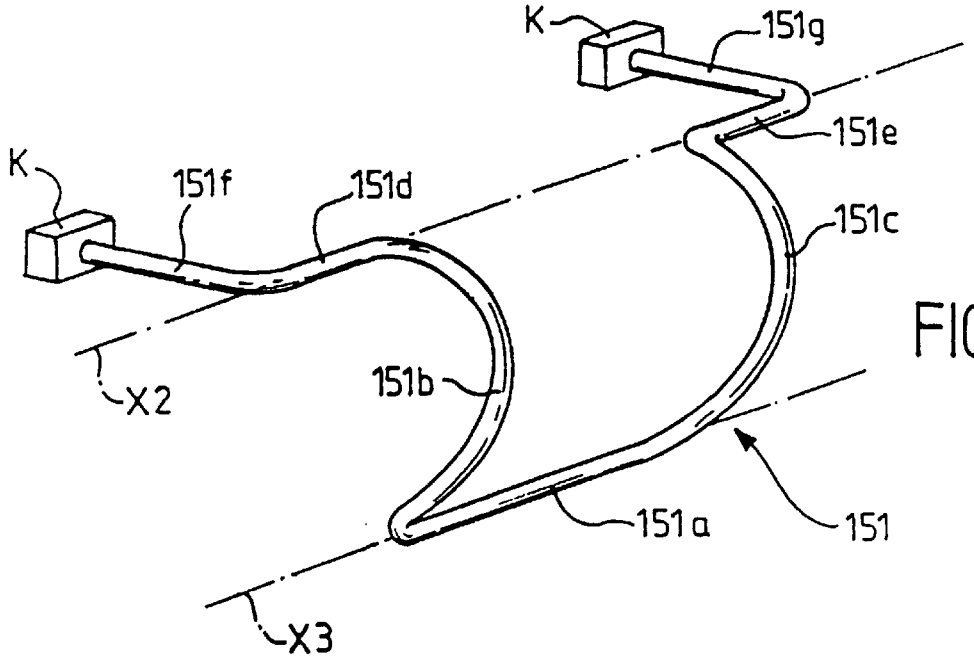
FIG. 10 illustrates, in perspective, one particular embodiment of a connecting rod for the toggle-joint device.

And finally, FIG. 11 is a partial section, similar to FIG. 4, illustrating a toggle-joint device equipped with the connecting rod of FIG. 10.

Figure 1:
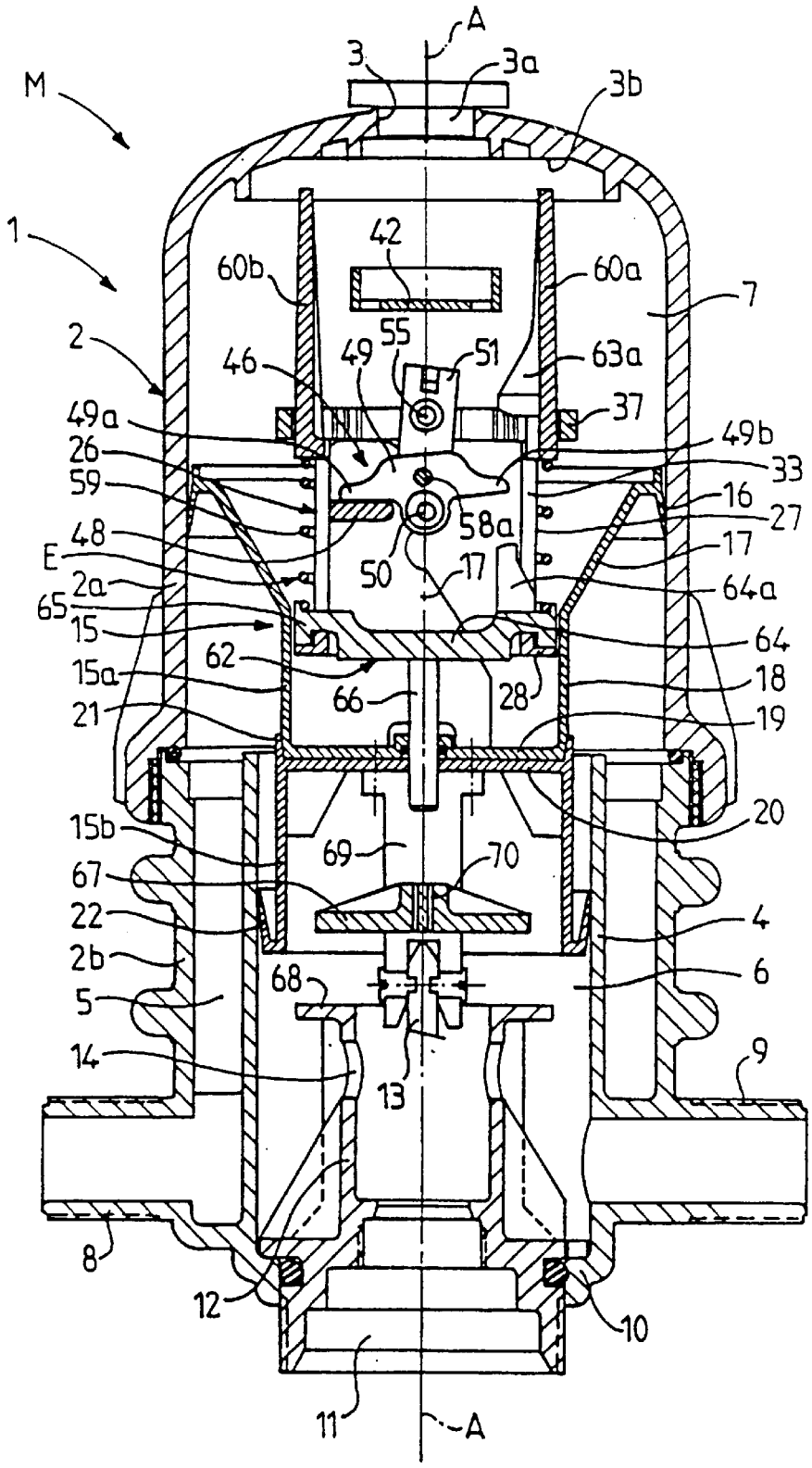

FIG. 1 of the drawings shows a hydraulic machine M consisting of a differential hydraulic motor 1. This motor comprises a machine envelope 2 or body, consisting of an upper part 2*a* and of a lower part 2*b* assembled in a sealed fashion. The general shape of the envelope 2 is cylindrical of revolution about a vertical axis A—A. The upper part 2*a* is closed, at its top end, by a dome which has a central opening 3 which, when the motor is operating, is closed by a plug 3*a*.

The lower part 2*b* has an interior cylindrical wall 4 of smaller diameter, determining an annular chamber 5 around it, inside 2*b*. This wall 4 also defines a cylindrical interior chamber 6 of smaller diameter than the chamber 7 determined at the top by 2*a*.

A threaded end piece 8, serving as a connector, emerges in the annular chamber 5. Another threaded end piece 9, diametrically opposite, emerges in the chamber 6 and is isolated from the annular chamber 5. Pressurized liquid arrives via the end piece 8, whereas evacuation is via the end piece 9.

At its lower end, the part 2*b* has a rim 10 surrounding an opening 11. The rim 10 acts as a support for a sleeve 12 through which a rod 13, depicted partially, for driving a mechanism, for example a pump, passes axially. The cylindrical wall of the sleeve 12 has openings 14 for the passage of the liquid.

A differential piston 15 is capable of sliding in a reciprocating vertical movement in the body 2 of the motor. The piston 15 has a large cross section in the region of the chamber 7 and a smaller cross section in the region of the chamber 6.

The differential piston 15 has an upper part 15*a* and a lower part 15*b* which are joined together in sealed fashion. The upper part 15*a* has an upper collar equipped with a sealing lip 16 forming a skirt, the concave side of which faces toward the chamber 5. The lip 16 glides in sealed fashion against the interior cylindrical surface of the part 2*a*. The collar bearing the lip 16 is connected by a frustoconical part 17, the cross section of which decreases toward the bottom, to a cylindrical part 18 of diameter smaller than that of the chamber 6. The part 18 ends in a transverse end wall 19 perpendicular to the axis A—A.

The lower part 15*b* of the piston 15 is essentially cylindrical and open at the bottom, and closed at the top by a transverse wall 20 pressing in sealed fashion against the end wall 19 to which it is fixed by screws which have not been depicted. The wall 20 is equipped at its periphery with a rim 21 which caps the lower end of the part 15*a*. The lower end of the part 15*b* is equipped, externally, with a lip 22 facing toward the chamber 7, gliding in sealed fashion against the interior surface of the wall 7.

Hydraulic switching means C (see, in particular, FIG. 2 and FIG. 9) for supplying the chambers 5, 6 and 7 with liquid and evacuating liquid therefrom are provided. These switching means C can adopt two stable states.

In a first state, corresponding to the depiction in FIG. 1, the annular chamber 5 situated beneath the lip 16 is isolated from the chamber 7 situated above the piston 15. This chamber 7 is then connected to the chamber 6 and to the exhaust 9. The pressurized liquid arriving through the connecting piece 8 causes the piston 15 to move upward.

In the other stable state of the switching means C, the pressurized liquid is let into the chamber 7 situated above the piston 15, the chamber 6 being isolated from the chamber 7. The piston 15 then moves downward (see FIG. 4).

The switching means C advantageously comprise two diametrically opposed valves 23 (FIG. 2) capable of collaborating with a seat 24 (FIG. 9) provided on the large cross section of the piston 15. Two more valves 25 which are diametrically opposed but angularly offset from the valves 23, are provided to collaborate with seats formed in the small-cross-section walls 19 and 20 of the piston 15.

Figure 2:
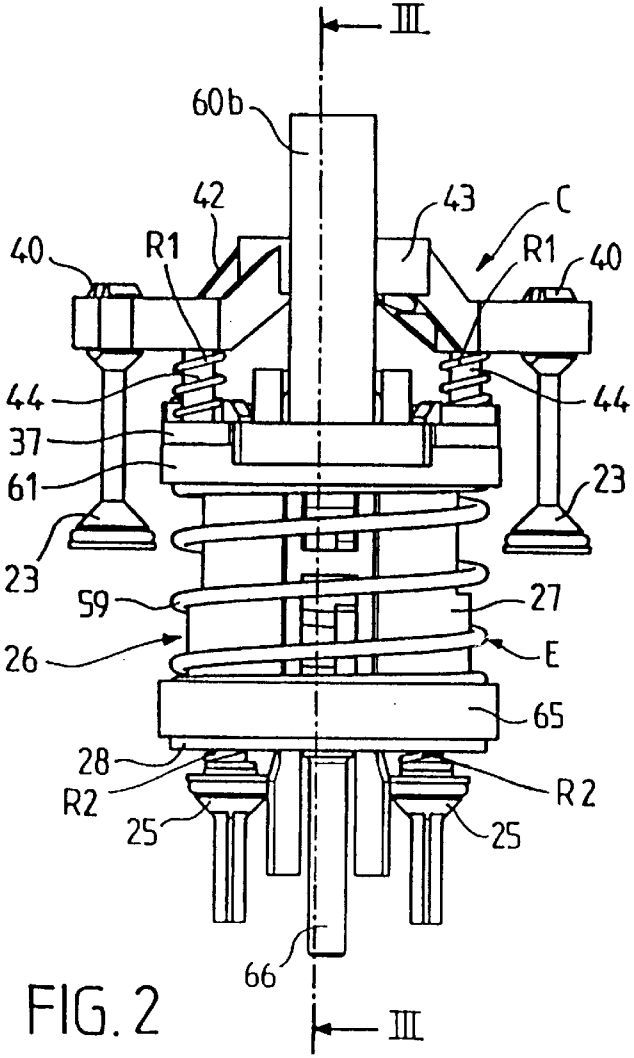
FIG. 2 is a view from the left, with respect to FIG. 1, of elements of the motor situated inside the envelope, the differential piston not being depicted.

As can be seen from FIG. 2, the valves 23 and 25 close in opposite directions. The valves 23 close by being lifted up against their seat, while the valves 25 close by being lowered onto their seat. Compression springs R1, R2 are provided to press the respective valves 23, 25 against their seat and to compensate for manufacturing tolerances.

Although the valves 23, 25 are the preferred solution, providing a very good seal, the switching means C could consist of one or more spool valves.

The valves 23, 25 are situated in front of and behind the plane of FIG. 1.

Figure 7:
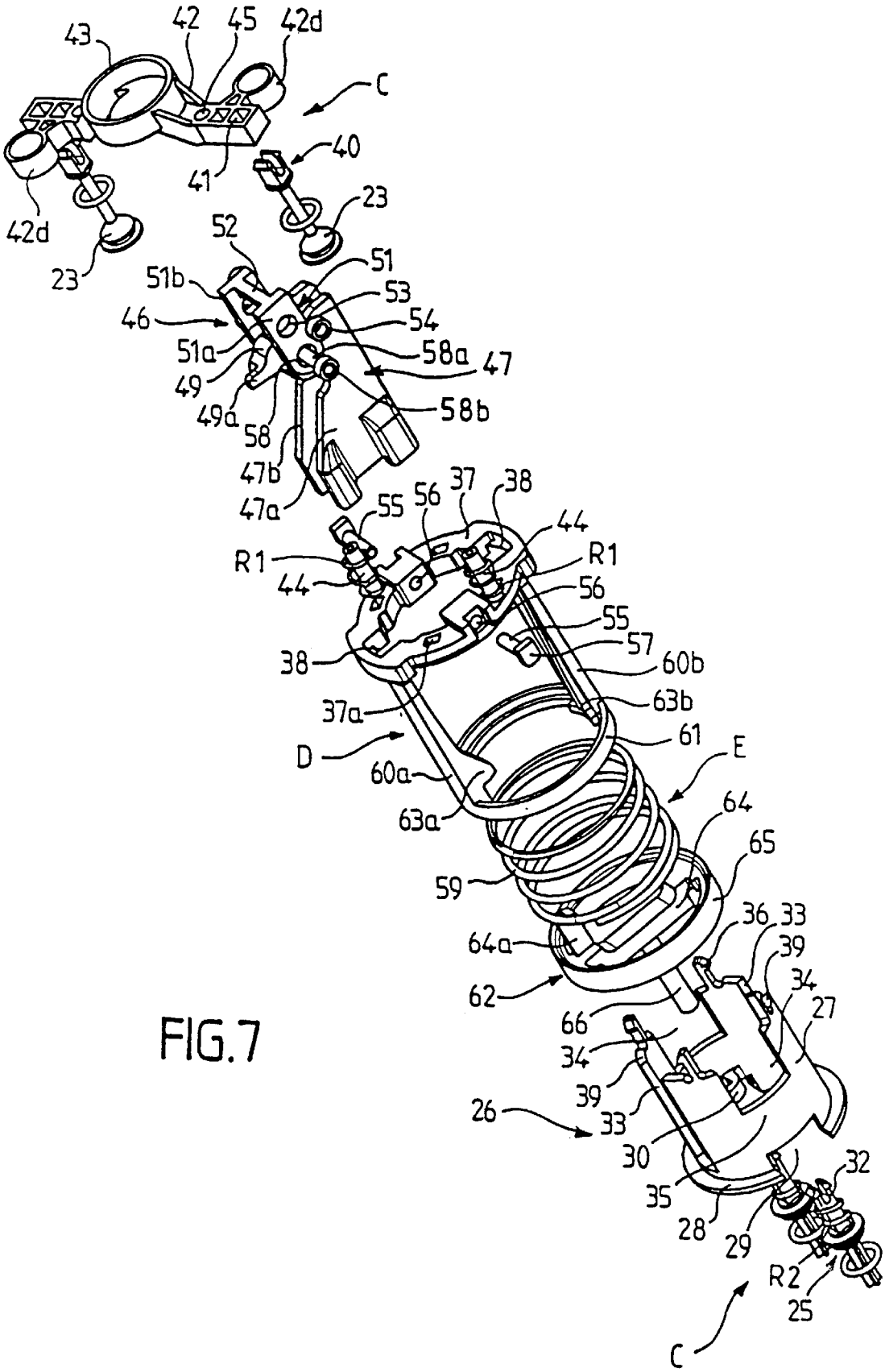
FIG. 7 is an exploded perspective view of components of the motor, the differential piston not being depicted.
Figure 8:
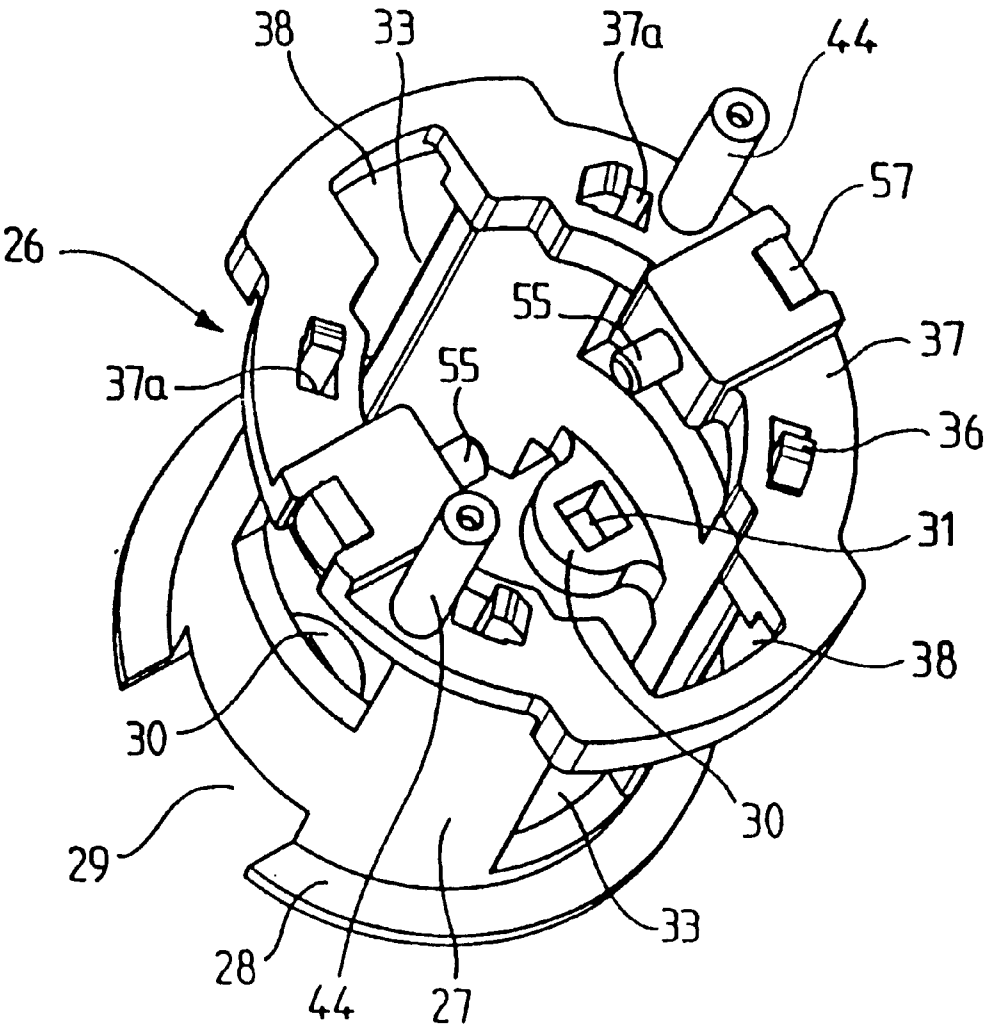
FIG. 8 is a perspective view of the lantern ring alone.

The switching means C are carried by a lantern ring 26 or open cylindrical housing clearly visible in FIG. 7 and FIG. 8. The lantern ring 26 comprises a body with a cylindrical side wall 27 coaxial with the piston, equipped at its lower part with a collar 28 projecting radially. Two diametrically opposed cutouts 29 are provided at the bottom, to which, on the inside, there correspond two diametrically opposed practically semi-cylindrical projections 30 (FIG. 8). Rectangular openings 31 are provided in the projections 13 to allow the clipping-in of the valves 25 which, at their upper end, are provided with elastic hooks 32. The valves 25 are designed to be attached to the lantern ring 26 in such a way as to leave the valve a certain freedom to slide vertically so as to allow the valve spring R2 mentioned earlier to press the valve firmly against its seat.

The cylindrical wall 27 of the body has two diametrically opposed longitudinal openings 33 with vertical parallel edges. The openings 33 are offset at right angles to the cutouts 29, open at the top and are closed at the bottom above the collar 28. The wall or body 27 also has cutouts 34 open at the top, diametrically opposed, in the same angular position as the cutouts 29 but separated from the latter by a sector 35 of material.

At the top, the body 27 has hooks 36, for example four of these, uniformly distributed, having a certain flexibility.

A plate 37, open in its central part and having two diametrically opposed cutouts 38 capable of aligning with the openings 33, is provided. This plate 37 has the same number of rectangular openings 37*a* as there are hooks 36 so that the hooks can clip into these openings.

On each side of the base of the hooks 36, the frontal end edge of the wall 27 forms an abutment surface 39 against which the lower face of the plate 37 bears when the hooks 36 are clipped in, as illustrated in FIG. 8.

The upper valves 23 are fitted with elastic hooks 40 (FIG. 7) capable of clipping into diametrically opposed rectangular openings 41 provided on a crossmember 42 which, at its central part, has an annulus 43.

The plate 37 has two posts 44 perpendicular to the plate, diametrically opposed and equipped with an axial hole. Two diametrically opposed housings 45 provided on the crossmember 42 near the annulus 43 fit respectively in a sliding manner over these posts 44. A spring R1 is arranged around each post 44 between the plate 37 and the crossmember 42. According to the depiction in FIG. 2, the springs R1 have a tendency to lift the crossmember 42, and with it the valves 23, to press them against their seat. A retaining means (not depicted) may be provided at the upper end of the posts 44 to prevent the crossmember 42 from escaping. It is to be noted that prior to the valves 23 being assembled with the crossmember 42 and with the lantern ring 26, the latter is first of all installed in the piston 15, guided by the cylindrical part 18 of this piston. The valves 23 are placed on the opposite side of the lip 16 of the piston to the crossmember 42 and their rods equipped with the hook 40 are engaged through the seat provided in the piston, and then secured to the crossmember 42.

The valves 25 on the other hand are secured to the lantern ring 26 before it is fitted in the piston 15, the seats of the valves 25 being on the wall 19, 20.

The lantern ring 26 is carried along by the piston 15 and can adopt two stable positions relative to this piston. A first is a top position (FIG. 1) relative to the piston and corresponds to the valves 23 pressing against their seat, while the lower valves 25 are open. The second position, or bottom position, of the lantern ring (FIG. 4) relative to the piston corresponds to the valves 25 being closed and the valves 23 being open.

The lantern ring 26 can be kept in one or other of the stable positions relative to the piston 15 by any appropriate means.

Figure 3:
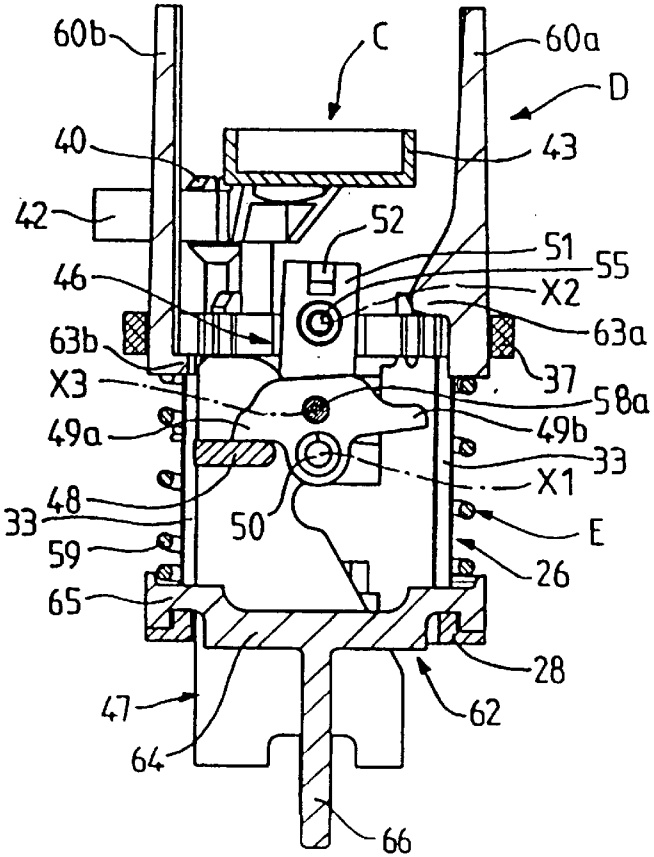
FIG. 3 is a section on III—III of FIG. 2.
Figure 5:
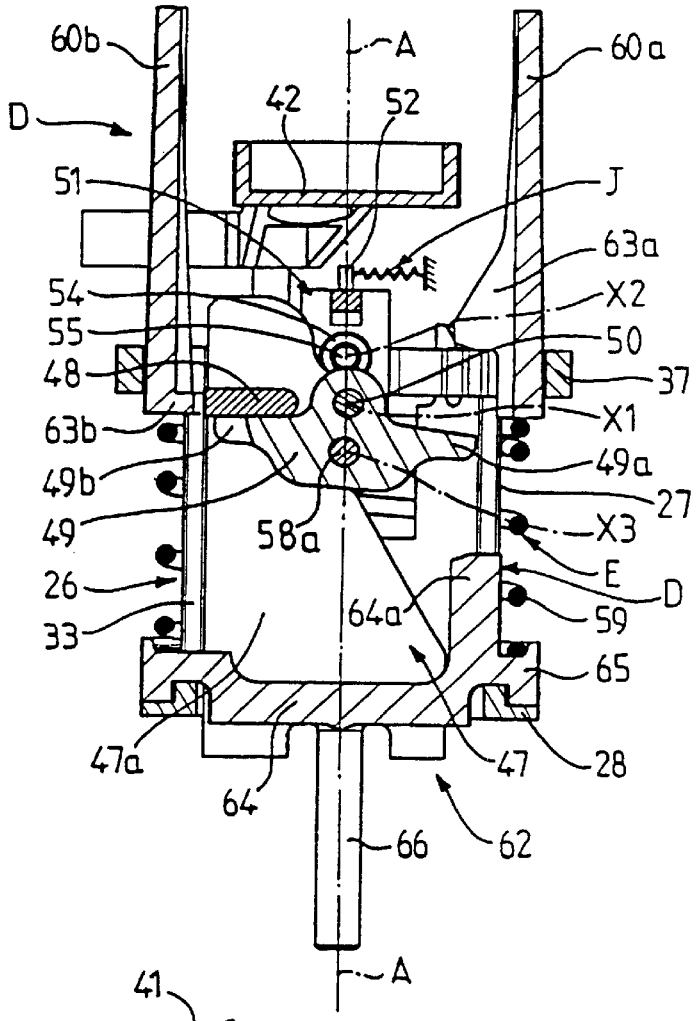
FIG. 5 is a section of the lantern ring, of the push-rods and of the elastic means on V—V of FIG. 6.
Figure 6:
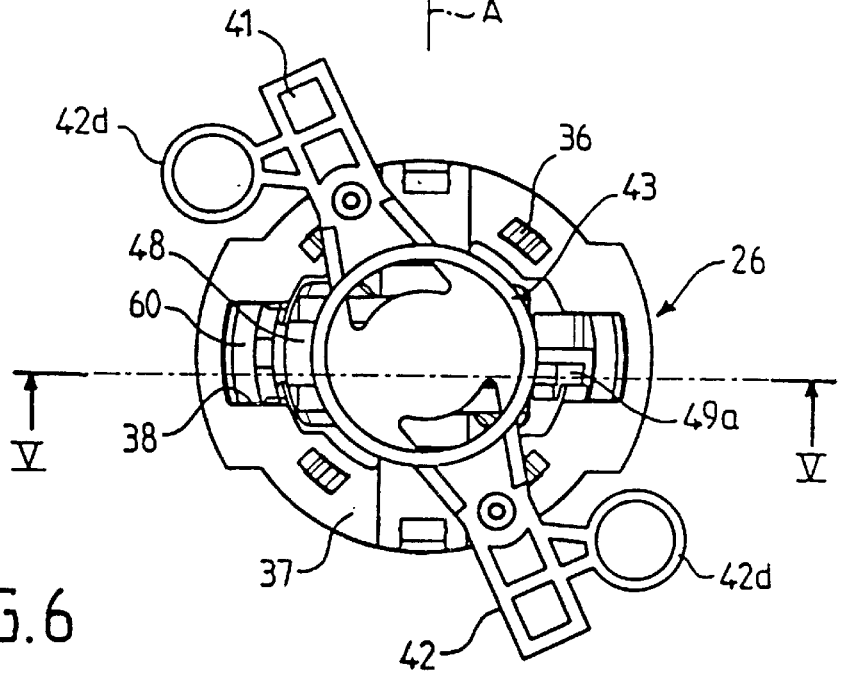
FIG. 6 is a view from above with respect to FIG. 2, the valves being removed.

One advantageous way of ensuring stability of either of the positions during the stroke of the piston consists of a connecting mechanism 46 of the toggle-joint type, with three parallel axes of rotation X1, X2, X3 perpendicular to the plane of FIGS. 3 and 5.

A support 47 is arranged inside the lantern ring 26 and is fixed, for example by screws, to the transverse walls 19, 20 of the differential piston 15. The support 47 consists of two vertical parallel panels 47*a*, 47*b* (FIG. 7) separated from one another and having an essentially right-trapezium-shaped contour; a long vertical side is adjacent to the interior surface of the lantern ring 26, the edge opposite this long vertical side is inclined. The two panels 47*a*, 47*b* are connected together, in their upper part, by a horizontal transverse bar 48.

A trigger or trip 49 is arranged between the panels 47*a*, 47*b* and is articulated to a shaft 50 of geometric axis X1. This shaft 50 is carried by two bearings provided in the panels 47*a*, 47*b*. The axis X1 lies in a diametral vertical plane of the lantern ring 26. The shaft 50 lies essentially at the height of the bar 48. The trigger 49 has two radial extensions 49*a*, 49*b*, which are not as thick as the trigger, and which are offset with respect to one another in the direction of the shaft 50.

A connecting rod 51 (FIGS. 3, 5 and 7) made of material which has a certain elasticity, for example of a plastic, establishes an articulated connection between the trigger 49 and the plate 37 of the lantern ring 26. The connecting rod 51, as clearly visible in FIG. 7, is essentially in the shape of an inverted U, the two plate-like branches 51*a*, 51*b* of which surround the trigger 49. These two branches are connected at their upper end by a small bar 52 which is not as wide as the branches. Each branch in its upper part near the small bar 52 has a circular hole 53 capable of accommodating an anti-friction bushing 54 itself having, passing through it, a shaft 55 engaged, from the outside, in a bearing 56 provided on the plate 37. Two diametrically opposed bearings 56 and two shafts 55 are provided to collaborate with the two diametrically opposed holes 53. Each shaft 55 projects radially inward to engage in the bushing 54 and the corresponding hole 53. The outer radial end of the shaft 55 has a rectangular head 57 immobilized in a corresponding housing in the plate 37. The bearings 56 have X2 as their geometric axis, parallel to the shaft 50. The axis X2 lies in the same vertical diametral plane as the geometric axis X1.

The two branches of the connecting rod 51 also have, toward their lower end, a circular hole 58 to act as a bearing for a shaft 58*a* which passes with freedom to rotate through a circular hole in the trigger 49. A bushing 58*b* is provided at each end of the shaft 58*a* in the corresponding hole 58. X3 is the geometric axis of the shaft 58*a*.

Two stable positions of the trigger 49 are determined by, on the one hand, the extension 49*a* coming into abutment with the upper face of the bar 48 (FIG. 3) and, on the other hand, by the extension 49*b* coming into abutment with the lower face of the bar 48 (FIG. 5). The switch from one position to the other is through a rotation of the trigger 49 by about 180° relative to the support 47 about X1.

In the stable position of FIG. 3, the lines of the three axes X1, X2 and X3 are at the vertices of a flattened triangle, the axis X3 being slightly to the left of the plane passing through the axes X1 and X2. The axis X3 is between X1 and X2. The lantern ring 26, and with it the valves 23, therefore occupy the top position, relative to the support 47 and to the piston 15, which corresponds to the upper valves 23 being closed while the valves 25 are open.

In order to pass through the angular position in which the three axes X1, X2 and X3 are in the same plane, the trigger 49 has to cause slight elastic deformation of the connecting rod 51.

In FIG. 5, X3 has moved to the opposite side of X1 to X2. The lines of the three axes X1, X2 and X3 still form a flattened triangle, the axis X3 lying slightly to the left of the plane passing through X2–X1. The lantern ring 26, and with it the valves, therefore occupy the bottom position relative to the support 47 and to the piston 15. The upper valves 23 are open while the valves 25 are closed.

Control means are provided to bring about an abrupt change from the position of FIG. 3 to that of FIG. 5 and vice versa. These control means comprise elastic means E exerting a force along the geometric axis A—A of movement of the piston.

The elastic means E are arranged on the outside of the cylindrical wall of the lantern ring 26 and are guided internally by the wall of the body 27 of the lantern ring 26.

Advantageously, the elastic means E consist of a single helical spring 59 coaxial with the lantern ring 26, and capable of working essentially in compression. The large-diameter spring 59 makes it possible to obtain good flexibility of operation and contributes to an embodiment which is simple by design. The cross section of the turns of the spring is relatively great, which improves its resistance to wear and corrosion.

As an alternative which has not been depicted, it would be possible, in place of a single spring 59, to provide several springs of smaller diameter arranged around the lantern ring 26 and guided by housings in the shape of open cylindrical cavities provided in the exterior wall of the lantern ring. The axes of these springs would be parallel to the axis A—A but radially separated from this axis. Arranging these springs symmetrically with respect to the axis A—A would make it possible to obtain a component along the axis A—A.

Triggering means D are provided for releasing, at the end of the stroke of the piston 15, the energy stored by the spring 59 and for causing the abrupt change in position of the lantern ring 26 and of the switching means C relative to the piston 15.

The triggering means D comprise, at the top, two diametrically opposed upper push-rods 60*a*, 60*b* connected at their base by a circular ring 61 and a lower push-rod 62 at the bottom.

The upper push-rods 60*a*, 60*b* consist of vertical branches engaged and guided in the cutouts 38 of the plate 37 of the lantern ring 26. The ring 61 passes around the cylindrical wall of the body 27 of the lantern ring which serves also to guide the assembly. The push-rods 60*a*, 60*b* have projections 63*a*, 63*b* radially inward which engage in the longitudinal openings 33 of the lantern ring, also contributing to guidance.

The projection 63*a* provided at the bottom of the push-rod 60*a* extends radially inward by enough distance that, at the end of the upstroke of the piston 15, it collaborates with the extension 49*b* of the trigger 49 (FIG. 3) and brings the trigger 49 into the position of FIG. 5. The thicknesses are offset so that 63*a* cannot collaborate with 49*a*.

The spring 59 presses against the ring 61 which itself presses against the lower face of the plate 37.

The lower push-rod 62 has a diametral crossmember 64 passing through the openings 33 which provide the push-rod 62 with guidance in its sliding. The crossmember 64 is secured to a ring 65 surrounding the lower part of the body 27 of the lantern ring 26 and bearing axially against the collar 28. Essentially semicircular openings (FIG. 7) exist between the diametral walls of the crossmember 64 and the interior contour of the ring 65, allowing the passage of the panels 47*a*, 47*b* of the support 47.

The crossmember 64 is equipped with a rod 66 coaxial with the piston 15, projecting on the opposite side to the spring 59. The rod 66 passes in sealed fashion, by virtue of an O-ring, through a central opening in the walls 19, 20.

At the end of the downstroke of the piston 15, the lower end of the rod 66 comes into abutment against a transverse bar 67 which, at each of its ends, bears against the upper transverse wall 68 of the sleeve 12.

The bar 67 is mounted to slide in a retaining piece 69 fixed to the piston 15 under the wall 20. The bar 67, on each of its long sides, has a rib 70 parallel to the axis A—A and capable of sliding in a groove (not depicted) provided in the piece 69. When the piston 15 occupies a relatively high position, the crossmember 67 rests on the closed end of the housing in the piece 69 a certain distance away from the lower end of the rod 66. When the piston 15 reaches its bottom position, the bar 67 bears against the wall 68 and stops moving downward while the piston 15 can continue its stroke so that the rod 66 can come into abutment against the bar 67.

Figure 9:
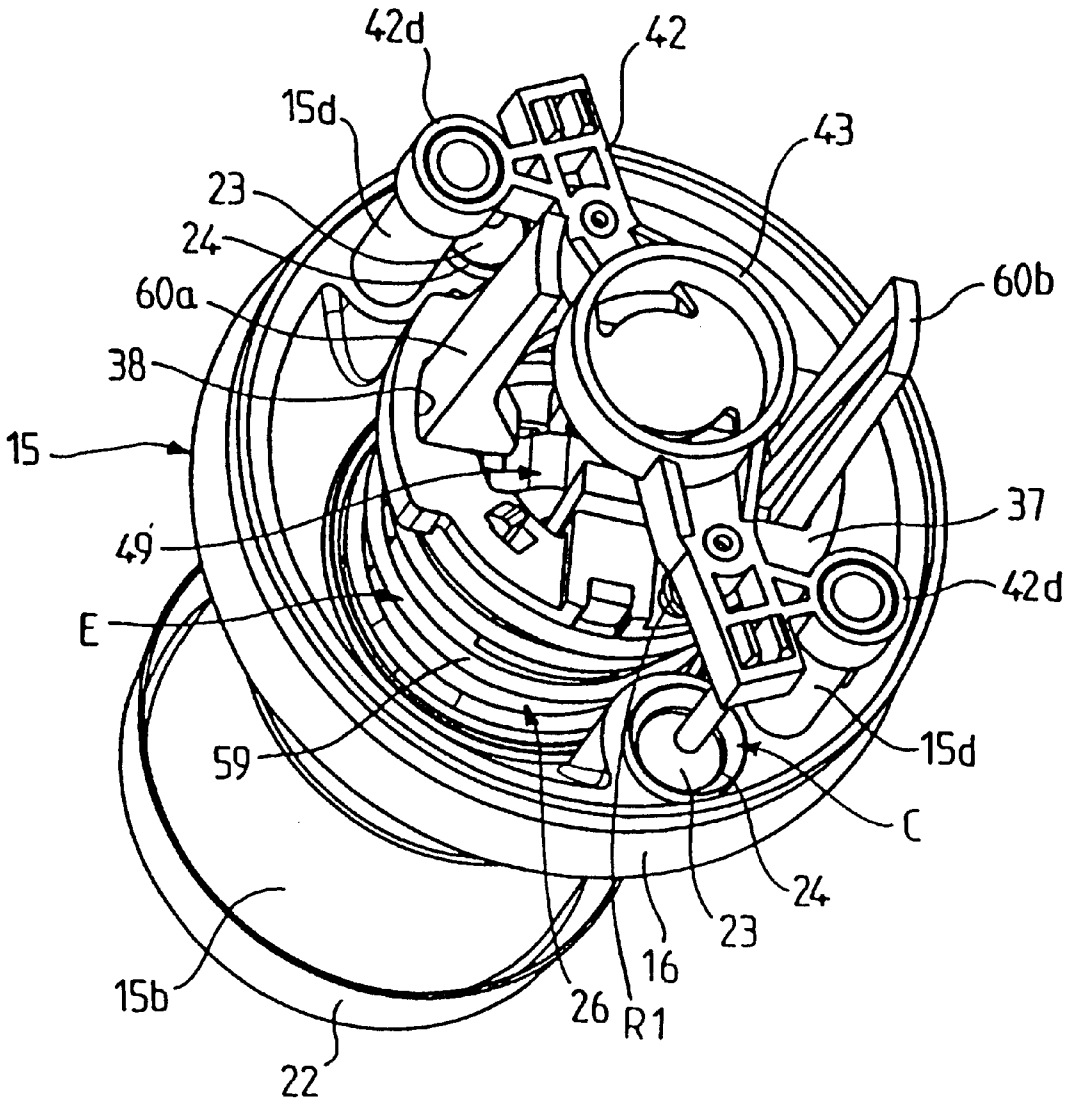
FIG. 9 is a perspective view of all of the elements arranged inside the envelope of the motor, the differential piston being depicted externally.

The crossmember 42 is held and guided relative to the differential piston 15 advantageously by two diametrically opposed cylindrical posts 15*d* (FIG. 9) forming an integral part of the piston 15, projecting vertically above the large cross section of the piston. The crossmember 42, toward each of its ends, has a cylindrical ring 42*d* capable of engaging with a small amount of clearance around the corresponding post 15*d*. The two rings 42*d*, as visible in FIG. 9, are located one on each side of the crossmember 42.

Elastic means J (FIG. 5) are provided for returning the connecting rod 51 of the toggle-joint mechanism to a locked position for which the axes X1, X2 and X3 are not coplanar. In the depiction of FIG. 5 the connecting rod 51 is subjected, by the elastic return means J depicted schematically, to a couple which tends to make it turn in the clockwise direction about the shaft 55. The elastic means J may consist of a tension means or of a compression means arranged between a point of attachment to the connecting rod 51 and a point of attachment fixed to the plate 37 of the lantern ring, or may consist of a bending spring such as a fairly straight hairpin spring running diametrically and bearing, on one side, against two diametrically opposed pegs secured to the plate 37 and, on the other side, in its central part, against a peg projecting upward from the connecting rod 51.

The crossmember 64 of the lower push-rod has, on one side, an upward projection 64*a* capable of collaborating with the extension 49*a* of the trip 49 as the piston 15 descends. The thicknesses are offset so that 64*a* cannot collaborate with 49*b*. The offsets of thickness and the offsets of the planes of section explain why 64*a* is visible in FIG. 5 but not in FIG. 3.

That being the case, the way in which the differential hydraulic motor works is as follows.

The motor is considered in its configuration of FIG. 1. As already mentioned, the valves 23 are closed, the crossmember 42 occupying a high position relative to the lantern ring 26. The chamber 5 is isolated from the chamber 7. By contrast, the lower valves 25 are open and the chamber 7 communicates with the chamber 6.

The pressurized liquid arriving via the chamber 5 pushes the piston 15 upward over its large annular section, while the liquid in the chamber 7 is evacuated to the chamber 6 and the exhaust 9.

The push-rods 60*a*, 60*b* are restrained by the plate 37 against the action of the spring 59, while the lower push-rod 62 is restrained by the collar 28 of the lantern ring 26.

Toward the end of the upstroke of the piston 15, the upper end of the push-rods 60*a*, 60*b* buts against the interior surface 3*b* of the dome of the envelope. The push-rods 60*a*, 60*b* are stopped in their upstroke but the piston 15 continues to move upward. The spring 59 is therefore compressed by the push-rods 60*a*, 60*b* against the lower push-rod 62. The upper plate 37 of the lantern ring continues to move upward and moves away from the base of the upper push-rods.

While the spring 59 is being compressed, the trigger 49 continues its upstroke with the piston 15; the extension 49*b* moves closer to the projection 63*a* of the push-rod 60*a*, then comes into abutment against the projection 63*a*.

The extension 49*b* is stopped but the piston 15 continues its upstroke a little further, carrying with it the shaft 50 about which the trip 49 is articulated. This trip will therefore rotate in the clockwise direction, according to the depiction in FIG. 1, about the shaft 50, causing slight deformation of the connecting rod 51 in order to pass through the position in which the three axes X1, X2 and X3 are in the same plane (their lines on the drawings are then aligned).

As soon as this restrained position has been passed, the spring 59 can relax, causing the trip 49 to rotate through about 180° in the clockwise direction, which trip will bear via its extension 49*b* under the bar 48 in the position of FIG. 5.

The lantern ring 26 and the switching means C have switched into the second stable position, namely the bottom position, relative to the differential piston 15. The ring 61 once again bears against the plate 37. The valves 23 are open whereas the valves 25 are closed.

The movement of the piston 15 is reversed because the pressurized liquid is let into the chamber 7 which is isolated from the chamber 6. The piston 15 moves downward in the configuration of FIG. 4.

Toward the end of the downstroke, the bar 67 comes into abutment against the wall 68, then the rod 66 (FIG. 4 and FIG. 5) of the lower push-rod 62 comes into abutment against this bar 67. The spring 59 is compressed by the lower push-rod 62, while the lantern ring 26 continues to move down with the piston. The collar 28 moves away from the crossmember 64.

At the end of the downstroke, the extension 49*a* of the trip comes into abutment against the projection 64*a* (FIG. 5), which causes the trip 49 to rotate through about 180° in the counterclockwise direction about the shaft 50. This change in position occurs abruptly under the action of the spring 59 which relaxes.

This is once again the configuration of FIG. 1 with the extension 49*a* bearing on the transverse bar 48.

The piston 15 starts out again for an upstroke.

The invention makes it possible to use a large-diameter compression spring 59 which gives great operational flexibility and allows an embodiment which is simple by design. The efficiency of the motor is improved and knocks during switching are reduced, leading to quieter operation.

Arranging the various moving parts coaxially along the axis of the spring makes it possible to reduce friction. The various parts are guided well as they move, and the piston 15 guides the lantern ring 26.

FIGS. 10 and 11 illustrate an alternative form of embodiment of a connecting rod 151 for the toggle-joint system with three axes X1, X2 and X3.

The connecting rod 151 is made as a single part out of an elastic material specified later. This connecting rod 151 has an essentially U-shaped central part, the horizontal transverse lower branch 151*a* of which is designed to constitute the shaft about which the trip 49 is articulated.

At each end, this horizontal branch 151*a* connects to a kind of bow 151*b*, 151*c* essentially in the shape of an arc of a circle and lying in a plane orthogonal to the branch 151*a*. The bows 151*b*, 151*c* are parallel. Their arched shape allows them to deform in bending and these bows can therefore exert essentially vertical tensile and compressive forces to allow the switch from the position in which the lines of the three axes X1, X2 and X3 are aligned.

The bows 151*b*, 151*c* are continued, at their upper end, by horizontal segments 151*d*, 151*e* curved outward and parallel to the branch 151*a*. These segments 151*d*, 151*e* have a certain elasticity in torsion about their geometric axis X2 so as to exert a return force on the branches 151*b* and 151*c* (and on the branch 151*a*) in rotation about the axis X2 to a position in which the axes X1, X2 and X3 are not coplanar, this position corresponding to a locked position. The segments 151*d*, 151*e* are continued by other segments 151*f*, 151*g* curved at right angles on the opposite side to the bows, parallel to each other, and orthogonal to the branch 151*a*. The ends of these segments 151*f*, 151*g* may be set into a component K secured to the lantern ring 26, it being possible, for example, for this component K to be the plate 37.

In order to be able to engage the branch 151*a* in the opening 152 of the trip, there is provided, beside this opening 152, an auxiliary opening 153 communicating with the previous one so as to pass the various elbows of the connecting rod 151 through the trip 49 and finally bring the branch 151*a* into the opening 152.

The connecting rod 151 performs both the function of the connecting rod 51 and the function of the elastic means J of FIGS. 1 to 9.

The connecting rod 151 is advantageously produced with longitudinal fibers having high mechanical strength, for example glass fibers, juxtaposed parallel to one another and embedded in a plastic matrix. The longitudinal fibers provide tensile and compressive elasticity in the vertical sense, at the bows 151*b*, 151*c*. In the segments 151*d*, 151*e*, torsional elasticity is provided by the plastic matrix.

The connecting rod 151 of FIG. 10 makes it possible to simplify the locking system of the toggle-joint type depicted in FIG. 11. The advantages of the embodiment of FIGS. 1 to 9 are kept in the device of FIG. 11.

Although the invention has been described with regards to a hydraulic motor, it may also apply to a hydraulic pump.

What is claimed is:

1. A hydraulic motor, comprising:

an envelope;

a differential piston capable of sliding in a reciprocating movement in the envelope, the piston having two parts of different diameters capable of moving in two corresponding chambers of the envelope;

hydraulic switching means for supplying ad evacuating the respective chambers, these switching means being driven by the piston and able to adopt two stable positions relative to the piston;

control means for an abrupt change in the position of the switching means relative to the piston, comprising elastic means capable of storing energy;

and triggering means capable, at the end of the stroke of the piston, of releasing the energy stored by the elastic means and of causing the abrupt change in position of the switching means, these triggering means comprising thrusting means which, at the end of the piston stroke, come to bear against stops which are fixed relative to the envelope, wherein:

the switching means are carried by a lantern ring with a side wall coaxial with the piston, driven by this piston but capable of adopting two different stable positions relative to the piston, the elastic means are arranged on the outside of the lantern ring and are guided internally by the side wall of the lantern ring, and the elastic means exert a force along a geometric axis of movement of the piston.

2. A hydraulic motor, comprising:

an envelope;

a differential piston capable of sliding in a reciprocating movement in the envelope, the piston having two parts of different diameters capable of moving in two corresponding chambers of the envelope;

hydraulic switching means for supplying and evacuating the respective chambers, these switching means being driven by the piston and able to adopt two stable positions relative to the piston;

control means for an abrupt change in the position of the switching means relative to the piston, comprising elastic means capable of storing energy, wherein the elastic means comprise a spring coaxial with the lantern ring and surrounding the lantern ring;

and triggering means capable, at the end of the stroke of the piston, of releasing the energy stored by the elastic means and of causing the abrupt change in position of the switching means, these triggering means comprising thrusting means which, at the end of the piston stroke, come to bear against stops which are fixed relative to the envelope, wherein:

the switching means are carried by a lantern ring with a side wall coaxial with the piston, driven by this piston but capable of adopting two different stable positions relative to the piston, and the elastic means are arranged on the outside of the lantern ring and are guided internally by the side, wall of the lantern ring.

3. A hydraulic motor according to claim 2, wherein the spring is a helical compression spring.

4. A hydraulic motor according to claim 3, wherein the lantern ring is guided in its lower part by a cylindrical region of the differential piston.

5. A hydraulic motor according to claim 3, wherein at least one push-rod is provided at each axial end of the lantern ring, the push-rod or push-rods of one end being independent of the push-rod or push-rods of the other end of the lantern ring, these push-rods bearing against the elastic means and being retained axially by stops provided on the lantern ring, which guides the push-rods in a translational movement.

6. A hydraulic motor according to claim 2, wherein the lantern ring is guided in its lower part by a cylindrical region of the differential piston.

7. A hydraulic motor according to claim 2, wherein at least one push-rod is provided at each axial end of the lantern ring, the push-rod or push-rods of one end being independent of the push-rod or push-rods of the other end of the lantern ring, these push-rods bearing against the elastic means and being retained axially by stops provided on the lantern ring, which guides the push-rods in a translational movement.

8. A hydraulic motor according to claim 1, wherein the switching means comprise valves.

9. A hydraulic motor according to claim 1, wherein the assembly consisting of the lantern ring, of the elastic means and of push-rods exhibits axial symmetry.

10. A hydraulic motor, comprising:

an envelope;

a differential piston capable of sliding in a reciprocating movement in the envelope, the piston having two parts of different diameters capable of moving in two corresponding chambers of the envelope;

hydraulic switching means for supplying and evacuating the respective chambers, these switching means being driven by the piston and able to adopt two stable positions relative to the piston;

control means for an abrupt change in the position of the switching means relative to the piston, comprising elastic means capable of storing energy;

and triggering means capable, at the end of the stroke of the piston, of releasing the energy stored by the elastic means and of causing the abrupt change in position of the switching mean, these triggering means comprising thrusting means which, at the end of the piston stroke, come to bear against stops which are fixed relative to the envelope, wherein:

the switching means are carried by a lantern ring with a side wall coaxial with the piston, driven by this piston but capable of adopting two different stable positions relative to the piston, the lantern ring is guided in its lower part by a cylindrical region of the differential piston, and the elastic means are arranged on the outside of the lantern ring and are guided internally by the side wall of the lantern ring.

11. A hydraulic motor, comprising:

an envelope;

a differential piston capable of sliding in a reciprocating movement in the envelope, the piston having two parts of diet diameters capable of moving in two corresponding chambers of the envelope;

hydraulic switching means for supplying and evacuating the respective chambers, these switching means being driven by the piston and able to adopt two stable positions relative to the piston;

control means for an abrupt change in the position of the switching means relative to the piston, comprising elastic moans capable of storing energy;

and triggering means capable, at the end of the stroke of the piston, of releasing the energy stored by the elastic means and of causing the abrupt change in position of the switching means, these triggering means comprising thrusting means which, at the end of the piston stroke, come to bear against stops which re fixed relative to the envelope, wherein:

the switching means are carried by a lantern ring with a side wall coaxial with the piston, driven by this piston but capable of adopting two different sable positions relative to the piston, the elastic means are arranged on the outside of the lantern ring and are guided internally by the side wall of the lantern ring, and at least one push-rod is provided at each axial end of the lantern ring, the push-rod or push-rods of one end being independent of the push-rod or push-rods of the other end of the lantern ring, the push-rods bearing against the elastic means and being retained axially by stops provided on the lantern ring, which guides the push-rods in a translational movement.

12. A hydraulic motor according to claim 11, wherein the lower push-rod has a diametral crossmember equipped with a rod coaxial with the piston, projecting on the opposite side to the elastic means.

13. A hydraulic motor according to claim 12, wherein the rod passes in sealed fashion through a transverse wall of the piston and comes into abutment, at the bottom end of travel, against a transverse bar which bears against a part of the envelope.

14. A hydraulic motor according to claim to 13, wherein the bar is mounted so that it can slide in a support connected to the piston.

15. A hydraulic motor according to claim 12, wherein the diametral crossmember is secured to a ring bearing against a lower rim of the lantern ring, this ring surrounding the side wall of the lantern ring which has two longitudinal guide openings through which the crossmember passes.

16. A hydraulic motor according to claim 11, wherein two diametrically opposed upper push-rods are provided and are guided by the lantern ring, particularly by longitudinal openings.

17. A hydraulic motor according to claim 16, wherein the lantern ring has an upper plate equipped, on the inside, with two diametrically opposed cutouts in which the upper push-rods are engaged and slide.

18. A hydraulic motor, comprising:

an envelope;

a differential piston capable of sliding in a reciprocating movement in the envelope, the piston having two parts of different diameters capable of moving in two corresponding chambers of the envelope;

hydraulic switching means for supplying and evacuating the respective chambers, these switching means being driven by the piston and able to adopt two stable positions relative to the piston;

control means for an abrupt change in the position of the switching means relative to the piston, comprising elastic means capable of storing energy;

and triggering means capable, at the end of the stroke of the piston, of releasing the energy stored by the elastic means and of causing the abrupt change in position of the switching means, these triggering means comprising thrusting means which, at the end of the piston stroke, come to bear against stops which are fixed relative to the envelope, wherein:

the switching means arc carried by a lantern ring with a side wall coaxial with the piston, driven by this piston but capable of adopting two different stable positions relative to the piston, the elastic means are and on the outside of the lantern ring and are guided internally by the side wall of the lantern ring, and the lantern ring is held stable in one of its two positions relative to the piston by a device of the toggle-joint type, with three axes, comprising a connecting rod and a trigger.

19. A hydraulic motor according to claim 18, wherein the connecting rod is articulated at one end to an upper plate of the lantern ring and at its other end to the trigger, the trigger being itself articulated to a component connected to the piston.

20. A hydraulic motor according to claim 18, wherein the trigger comprises two diametrically opposed extensions capable of coming into abutment against a stop connected to the piston, respectively above and below this stop following rotation through about 180°, each extension of the trigger being capable of collaborating with a projection provided respectively on an upper push-rod and on a lower push-rod so as to trip the trigger when the elastic means are under sufficient load.

* * * * *